US006318695B1

(12) United States Patent
Hu

(10) Patent No.: US 6,318,695 B1
(45) Date of Patent: Nov. 20, 2001

(54) NOTEBOOK COMPUTER KEY

(75) Inventor: Gino Hu, Taipei (TW)

(73) Assignee: Silitek Corp., Taipei (TW)

( * ) Notice: Subject to any disclaimer, the term of this patent is extended or adjusted under 35 U.S.C. 154(b) by 0 days.

(21) Appl. No.: 09/342,205

(22) Filed: Jun. 29, 1999

(51) Int. Cl.[7] ..... A47G 29/00; H01H 13/70
(52) U.S. Cl. ..... 248/371; 200/345
(58) Field of Search ..... 200/345; 248/371, 248/127, 372.1

(56) References Cited

U.S. PATENT DOCUMENTS

| | | | | |
|---|---|---|---|---|
| 5,268,545 | * | 12/1993 | Bruner | 200/345 |
| 5,555,971 | * | 9/1996 | Takada | 200/345 |
| 5,562,203 | * | 10/1996 | Mochuzuki | 200/345 |
| 5,597,067 | * | 1/1997 | Yoneyama | 200/345 |
| 5,654,872 | * | 8/1997 | Sellers | 200/345 |
| 5,769,210 | * | 6/1998 | Tsai | 200/345 |
| 5,772,008 | * | 6/1998 | Yu et al. | 200/345 |
| 5,898,145 | | 4/1999 | Su . | |
| 5,967,298 | * | 10/1999 | Watanabe et al. | 200/345 |

* cited by examiner

*Primary Examiner*—Ramon O. Ramirez
*Assistant Examiner*—Jerome A. DeLuca
(74) *Attorney, Agent, or Firm*—Rosenberg, Klein & Lee

(57) ABSTRACT

A notebook computer key comprises a key hat, a seat, an elastic touch moving piece, a first supporting frame and a second supporting frame. The key hat is formed with an operating surface and an assembling surface at the top surface and the lower surface. The seat is installed with a plurality of through holes, each through hole is installed with a positioning piece. The elastic touch moving piece installed between the key hat and the seat. The first supporting frame and second supporting frame installed between the assembling surface of the key hat and the seat. The two supporting frames are pivotally connected. The upper ends of the two supporting frames are connected to the assembling surface of the key hat, and each lower end of two sides of the two supporting frames are installed with a pivotal shaft for being pivotally connected to the through hole of the seat. The pivotal shaft at lower end of each side of the two supporting frames are protruded from the first lateral wall and the second lateral wall of the supporting frame. The pivotal shaft at each lower end of two sides of the two supporting frames is inserted into the through hole pivoted. Therefore, the height of the key is reduced and the requirement of compact of modem products is met.

2 Claims, 5 Drawing Sheets

24
30
31
13

24
31
32
13
30

30
24
32
13

13
32
31
24

30
32
24
13
31

NOTEBOOK COMPUTER KEY

BACKGROUND OF THE INVENTION

1. Field of the Invention

The present invention relates to a notebook computer key, and especially to a key structure, thereby, the height of the key is reduced and the requirement of compact of modern products is met.

2. Description of the Prior Art

As shown in FIG. 1, the bridge type key 10*a* of a prior art notebook computer primarily includes a key hat 11*a*, an elastic touch moving piece 12*a*, a first supporting frame 13*a*, a second supporting frame 14*a* and a seat 16*a*. The first supporting frame 13*a* and second supporting frame 14*a* is crossed with one another. The pivotal shafts 18*a* and 19*a* at lower ends of the first supporting frame 13*a* and second supporting frame 14*a* are pivotally connected to the pivotal seats 20*a* and 21*a* protruded from the top of the seat 16*a*. The upper ends of the first supporting frame 13 and the second supporting frame 14*a* are connected to the key hat 11*a*. The two supporting frames are formed as a linkage. An elastic touch moving piece 12*a* is located in the traveling of the key hat 11*a*. The key hat 11*a* is guided by the two supporting frames 13*a* and 14*a* so that as it moves upwards and downwards, it will touch-press or leave from a soft circuit board 15*a* so that the switch will turn on or off. Such kind of design is disclosed in Taiwan Patent Nos. 237991 and 303971.

In the aforementioned prior art notebook computer key 10*a*, the pivotal shafts 18*a* and 19*a* at lower ends of the two supporting frames 13*a* and 14*a* are pivotally connected to the pivotal seats 20*a* and 21*a* protruded from the top end of the seat 16*a*. Therefore, the whole height of the key 10*a* will increase. This kind of design dose not conform the modern requirement of compactness.

SUMMARY OF THE INVENTION

A notebook computer key comprises a key hat, a seat, an elastic touch moving piece, a first supporting frame and a second supporting frame. The key hat is formed with an operating surface and an assembling surface at the top surface and the lower surface further. The seat is installed with a plurality of through holes, each through hole is installed with a positioning piece. The elastic touch moving piece installed between the key hat and the seat. The first supporting frame and second supporting frame installed between the assembling surface of the key hat and the seat. The two supporting frames are pivotally connected. The upper ends of the two supporting frames are connected to the assembling surface of the key hat, and each lower end of two sides of the two supporting frames are installed with a pivotal shaft for being pivotally connected to the through hole of the seat. The pivotal shaft at lower end of each side of the two supporting frames are protruded from the first lateral wall and the second lateral wall of the supporting frame. The pivotal shaft at each lower end of two sides of the two supporting frames is inserted into the through hole pivoted. Therefore, the height of the key is reduced and the requirement of compact of modern products.

The present invention will be better understood and its numerous objects and advantages will become apparent to those skilled in the art by referencing to the following drawings in which:

DETAILED DESCRIPTION OF THE PREFERRED EMBODIMENT

Figure 1:
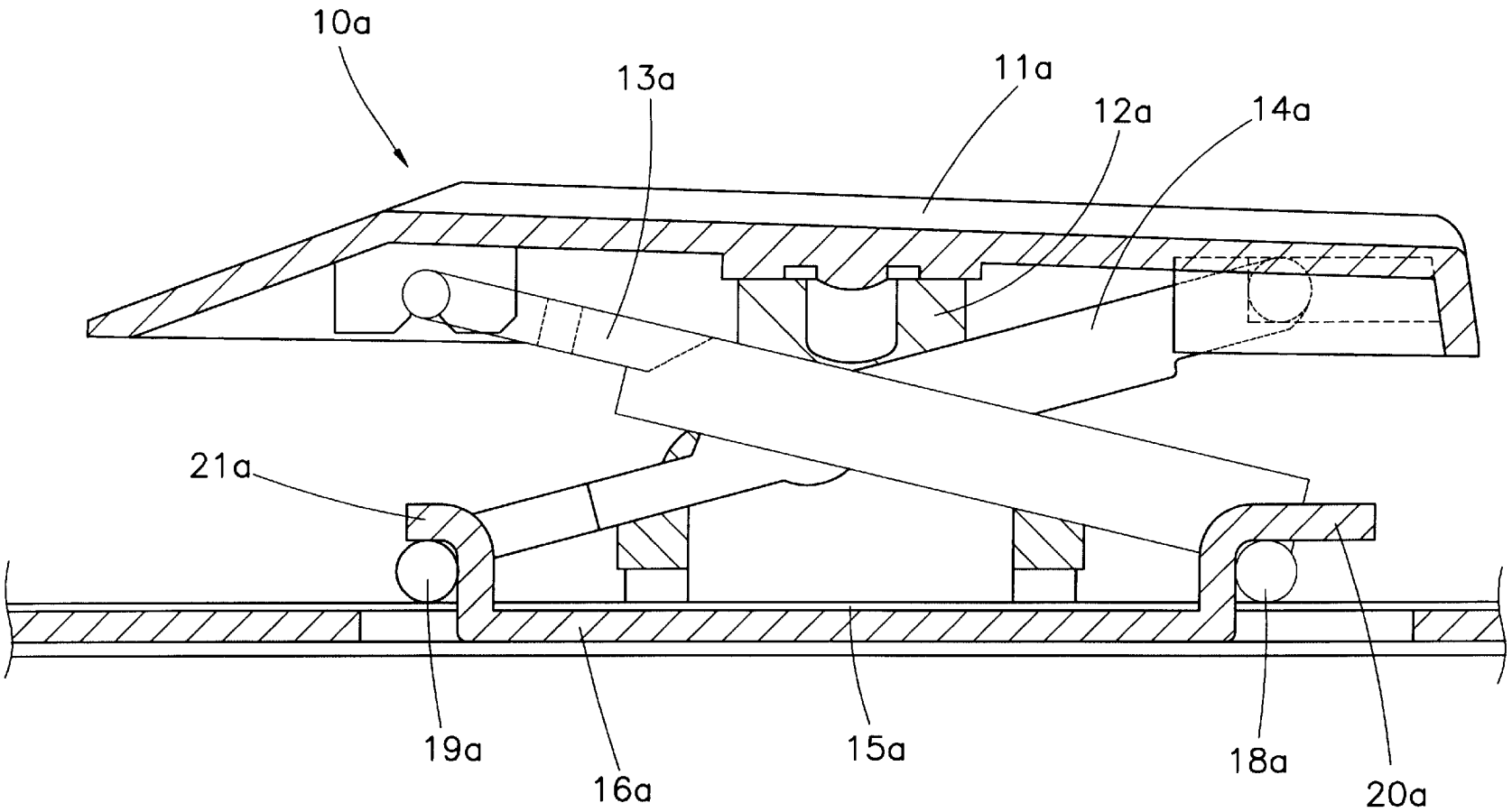
FIG. 1 PRIOR ART
FIG. 1 is a plane schematic view of a prior art key.
Figure 2:
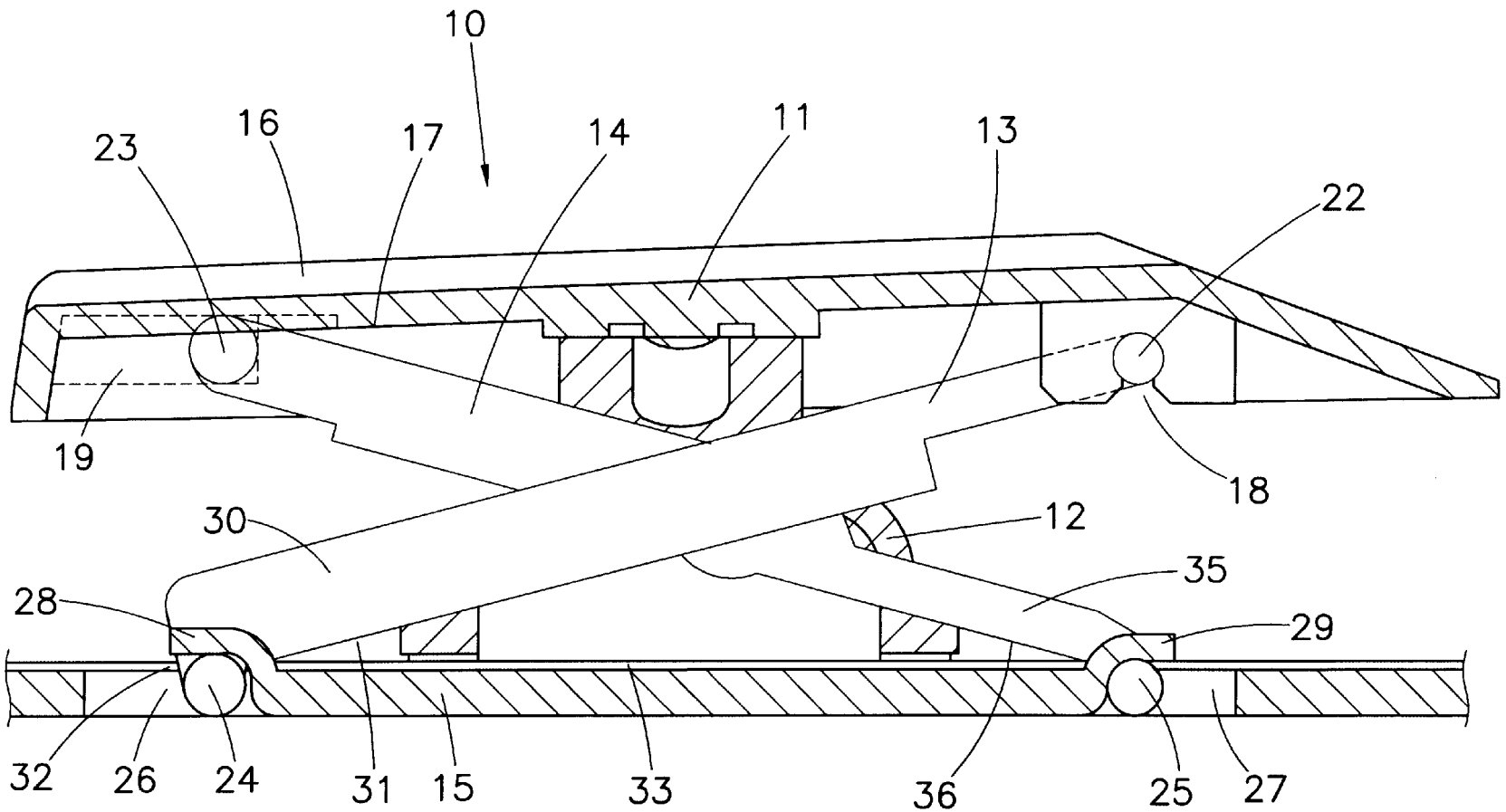
FIG. 2 is a plane view of the present invention.
Figure 3:
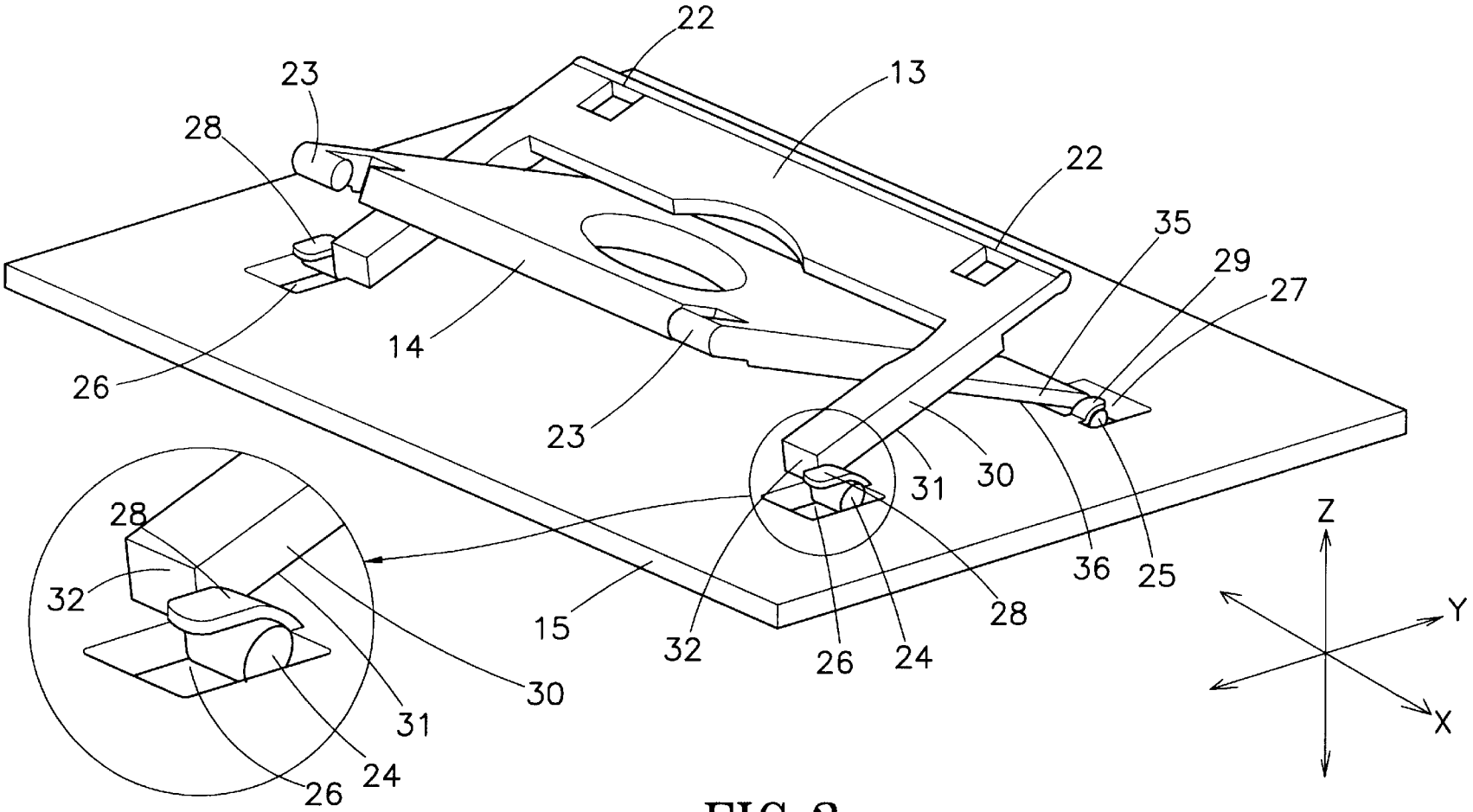
FIG. 3 is a perspective view of the supporting frame and the seat of the present invention.
Figure 4:
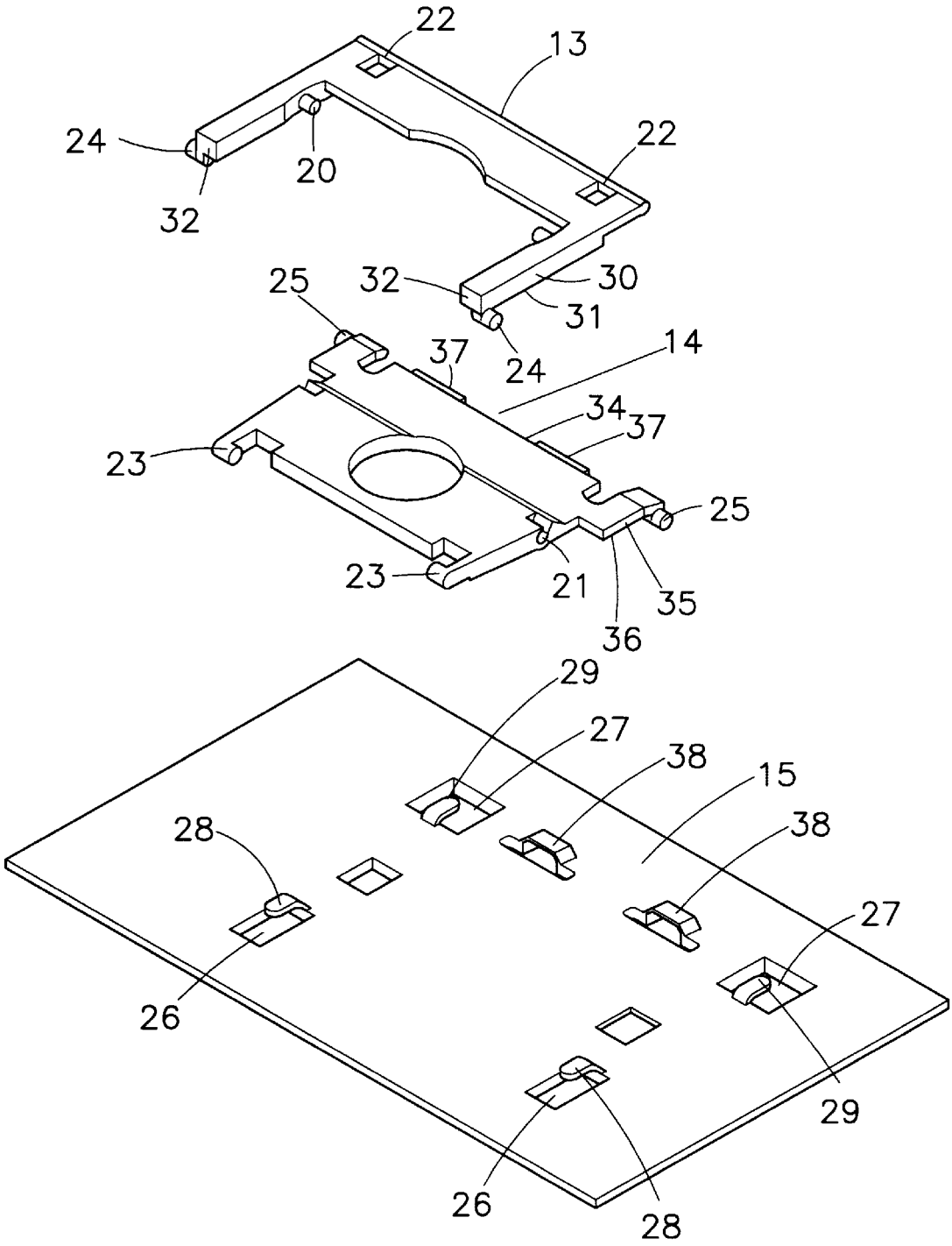
FIG. 4 is an exploded perspective view of the supporting frame and seat of the present invention.

With reference to FIGS. 2, 3, and 4, a notebook computer key of the present invention is illustrated. The key 10 includes a key hat 11, an elastic touch moving piece 12, a first supporting frame 13, a second supporting frame 13 and a base 1. The key hat 11 is a rectangular key hat. The top and bottom thereof are formed with an operating surface 16 and an assembling surface 17. The assembling surface 17 is installed with two pivotal shafts 18 and two sliding grooves 19.

The first supporting frame 13 and the second supporting frame 14 are arranged between the assembling surface 17 and the seat 15. Pivotal shafts 20 and pivotal holes 21 are installed on the middle portions of the two sides of the first supporting frame 13 and second supporting frame 14. Thus, the first supporting frame 13 and second supporting frame 14 are pivotally connected as interleaved linkage means.

The elastic touch moving piece 15 is installed between the key hat 11 and the base 15. The elastic touch moving piece 15 is in the traveling length of the key hat 11. The two sides of the first supporting frame 13 are installed with respective pivotal shafts 22 at the upper ends thereof. Each of the two sides of the second supporting frame 14 is installed with a sliding shaft 23. The supporting frames 13 and 14 are pivotally and slidably connected to the pivotal hole 18 and the sliding groove 19 by the pivotal shafts 22 and sliding shafts 23 at the upper ends of two sides thereof, thus the first supporting frame 13 and the second supporting frame 14 are connected to the assembling surface 17 of the key hat 11 at the upper ends thereof.

Figures 5A, 5B, 5C, 5D, 5E:
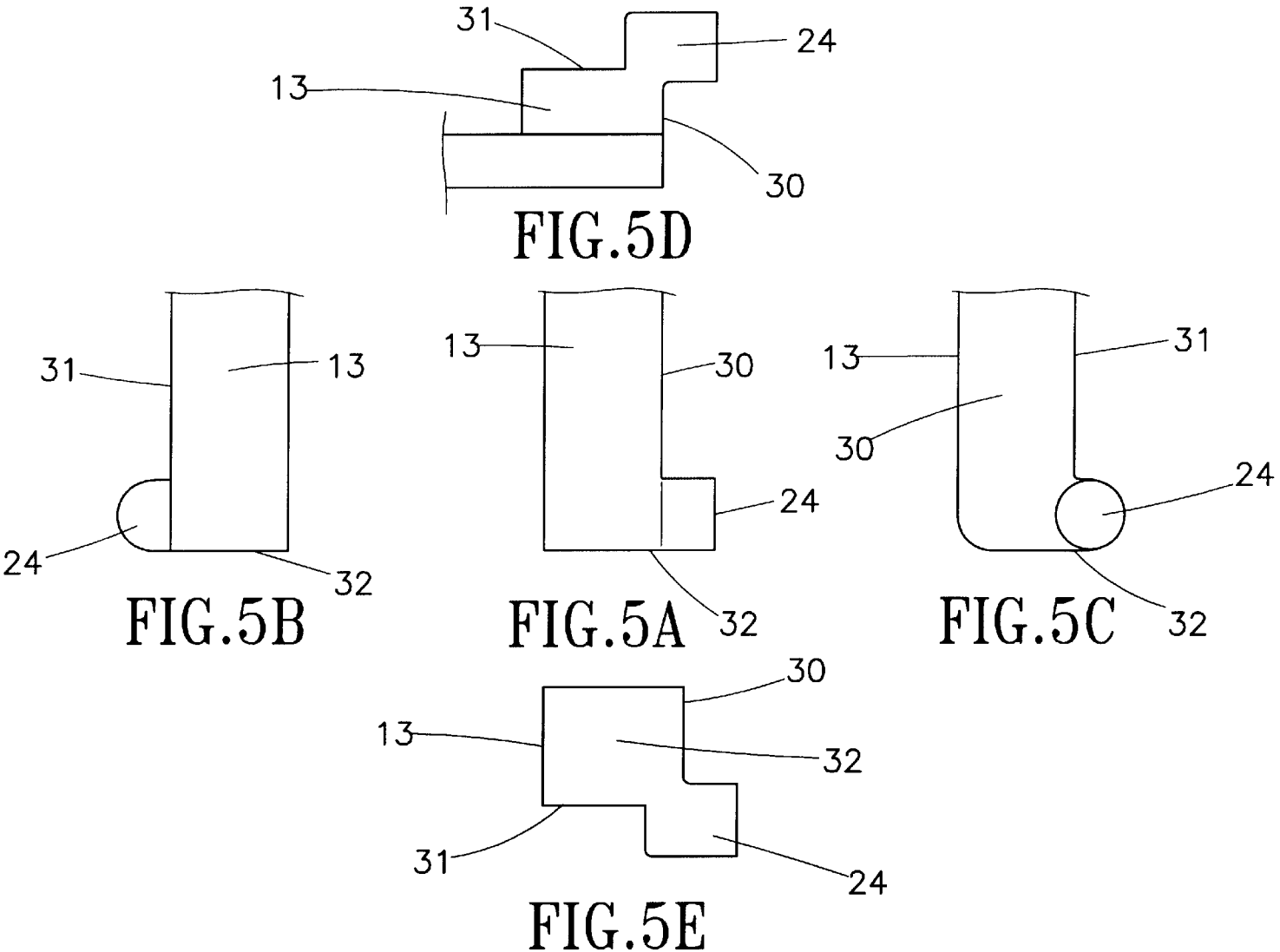
FIG. 5A is a front view of the pivotal shaft at lower end of the first supporting frame of the present invention.
FIG. 5B is a left side view of the pivotal shaft at lower end of the first supporting frame of the present invention.
FIG. 5C is a right side view of the pivotal shaft at lower end of the first supporting frame of the present invention.
FIG. 5D is a upper view of the pivotal shaft at lower end of the first supporting frame of the present invention.
FIG. 5E is an upper view of the pivotal shaft at lower end of the first supporting frame of the present invention.

The lower ends at two sides of the first supporting frame 13 and the second supporting frame 14 are installed with respective pivotal shafts 24 and 25 pivotally connected to the through holes 26 and 27 preset on the seat 15. The upper sides of the through holes 26 and 27 are installed with respective positioning pieces 28 and 29 for confining the upward displacement of the pivotal shafts 24 and 25. A soft circuit board 33 is installed on the seat 15. The key hat 11 is guided by two supporting frames 13 and 14 so as to move upwards and downwards. The elastic touch moving piece 12 on lower side of the key hat 11 may touch-press or separate with the soft circuit board 33 so that the switch may be turned on or off. In the present invention, primarily, the pivotal shafts 24 at lower ends of the two sides of the first supporting frame 13 are improved. The pivotal shaft 24 is protruded from a lateral wall 30 (outer lateral wall) and a second lateral wall 31 (front lateral wall or rear lateral wall) (as FIG. 5A and FIG. 5E) of the first supporting frame 13. When pivotal shafts 24 at lower ends of two sides of the first supporting frame 13 are pivotally connected to the through holes 26 of the seat 15, most of each pivotal shaft 24 is inserted into the through hole 26. The second supporting frame 14 (or the second supporting frame 13) has end portion 34 at lower end thereof. The end portion 34 is protruded with at least one convex body 37 and respective stopper 38 are protruded from the seat 15. The pivotal shafts 25 at lower ends of two sides of the second supporting frame 14 have a structure identical to the pivotal shafts 24 at lower ends of the two sides of the first supporting frame 13. Namely, the pivotal shaft 25 is protruded from the first lateral wall (outer lateral wall) 35 and the second lateral wall (front lateral wall or rear lateral wall) 36 of the second supporting frame 14, thus, the pivotal shaft 25 may inserted into the through hole 27. Since the pivotal shafts 24 and 25 at lower ends of the two sides of the first supporting frame 13 and second supporting frame 14 may be inserted into the through holes 26 and 27. Therefore, the height of the key is reduced greatly so that the requirement of compactness of modem product is matched.

The pivotal shafts 24 and 25 at lower ends of the two sides of the first supporting frame 13 and second supporting frame 14 provide a stopping effect for upward movement through the positioning pieces 28 and 29. While, the end portions 32 and 34 at lower ends of the two sides of the first supporting frame 13 and second supporting frame 14 provide a stopping effect through the seat 15 so as to prevent the downward movement of the pivotal shafts 24 and 25 at lower ends of the supporting frames 13 and 14. As a result, the supporting frames 13 and 14 may have a preferred positioning effect in the Z axis (upper and lower directions). The first lateral walls 30 and 35 of the two lateral walls 13 and 14 may prevent a stopping effect to the leftward and rearward displacement by the positioning pieces 28 and 29. Further, the pivotal shafts 24 and 25 at lower ends of the supporting frames 13 and 14 provides a stopping effect to the leftward and rightward movements of the lateral walls through the through holes 26 and 27. Thus, he supporting frames 13 and 14 is well positioned in the X directions (left and right). Moreover, the pivotal shafts 24 and 25 provides a stopping effect to the forward and rearward movement by the positioning pieces 28 and 29. Further, the stopping edge 38 of the seat 15 provides a stopping effect to the forward and rearward movement of the protrusion 37 at lower end of the second supporting frame 14 (or first supporting frame 14). Thus, the second supporting frame 13 and 14 are well positioned in the Y axis (front, rear). Thus, the two supporting frames 13 and 14 are well positioned in three axial directions. The two supporting frames 13 and 14 can be steadily and pivotally connected to the seat 15.

Although the present invention has been described using specified embodiment, the examples are meant to be illustrative and not restrictive. It is clear that many other variations would be possible without departing from the basic approach, demonstrated in the present invention.

What is claimed is:

1. A notebook computer key comprising:

a key hat formed with an operating surface and an assembling surface respectively at a top surface and a lower surface thereof;

a seat defining an upper surface having a plurality of through holes formed therein, the seat having a plurality of positioning pieces formed thereon, each of said plurality of positioning pieces extending at least partially across a respective one of said through holes, said seat including a protrusive stopping edge portion;

an elastic touch moving piece installed between the key hat and the seat; and a first supporting frame and a second supporting frame installed between the assembling surface of the key hat and the seat, the two supporting frames being pivotally connected together to form a crossed linkage, each of the first and second supporting frames having respective upper ends connected to the assembling surface of the key hat, each of the first and second supporting frames having a pair of lower ends on two respective sides thereof with a pivotal shaft coupled to each said lower end, each said lower end having first and second lower side surfaces transversely oriented one relative to the other, each said pivotal shaft extending laterally from said first lower side surface of said lower end and protruding from said second lower side surface of said lower end, each said pivotal shaft of both said first and second supporting frames extending at least partially below the plane of said seat upper surface into a respective one of said plurality of through holes beneath a corresponding one of said plurality of positioning pieces for respective pivotal coupling to the seat, while each said lower end of both said first and second supporting frames remains at or above the plane of said seat upper surface;

at least one of said first and second supporting frames includes an end portion disposed laterally between said lower ends thereof, said end portion having at least one convex body protruding therefrom for abuttingly engaging said stopping edge portion.

2. A notebook computer key comprising:

a key hat formed with an operating surface and an assembling surface respectively at a top surface and a lower surface thereof;

a seat having a plurality of through holes formed therein, the seat having a plurality of positioning pieces formed thereon, each of said plurality of positioning pieces extending at least partially across a respective one of said through holes, said seat including a protrusive stopping edge portion;

a circuit board layer juxtaposed on an upper surface of said seat;

an elastic touch moving piece installed between the key hat and said circuit board layer; and a first supporting frame and a second supporting frame installed between the assembling surface of the key hat and the seat, the two supporting frames being pivotally connected together to form a crossed linkage, each of the first and second supporting frames having respective upper ends connected to the assembling surface of the key hat, each of the first and second supporting frames having a pair of lower ends on two respective sides thereof with a pivotal shaft coupled to each said lower end, each said lower end having first and second lower side surfaces transversely oriented one relative to the other, each said pivotal shaft extending laterally from said first lower side surface of said lower end and protruding from said second lower side surface of said lower end, each said pivotal shaft of both said first and second supporting frames extending at least partially below the plane of said seat upper surface into a respective one of said plurality of through holes beneath a corresponding one of said plurality of positioning pieces for respective pivotal coupling to the seat, while each said lower end of both said first and second supporting frames remains at or above the plane of said seat upper surface;

at least one of said first and second supporting frames includes an end portion disposed laterally between said lower ends thereof, said end portion having at least one convex body protruding therefrom for abuttingly engaging said stopping edge portion.

* * * * *